US006019335A

United States Patent [19]

Sehati

[11] Patent Number: 6,019,335

[45] Date of Patent: Feb. 1, 2000

[54] WATER AND SODA BOTTLE HOLDER

[76] Inventor: Shahbaz Sehati, 1148 Colina Vista, Ventura, Calif. 93003

[21] Appl. No.: 08/922,096

[22] Filed: Sep. 2, 1997

[51] Int. Cl.[7] ..... A47K 1/08; A45F 3/16; A45F 5/00

[52] U.S. Cl. ..... 248/312; 224/148.4

[58] Field of Search ..... 248/682, 312, 248/102, 103, 104, 689, 691, 692, 213.2, 230.7, 230.8, 312.1, 315, 316.7, 318; 224/148.1, 148.4, 148.7, 195, 666, 667, 668, 251, 255, 269, 270, 247, 248, 148.6, 901.4

[56] References Cited

U.S. PATENT DOCUMENTS

| | | | |
|---|---|---|---|
| 1,236,929 | 8/1917 | Hauck | 248/312 |
| 1,403,707 | 1/1922 | Quarnstrom | 362/396 |
| 1,464,659 | 8/1923 | Keely | 224/247 |
| 1,611,275 | 12/1926 | Lewis | 224/197 |
| 2,614,305 | 10/1952 | Yeardley | 248/315 |
| 2,733,492 | 2/1956 | Copell | 248/316.7 |
| 2,926,403 | 3/1960 | Weissman | 224/247 |
| 3,192,894 | 7/1965 | Staver | 248/312 |
| 3,233,802 | 2/1966 | Ludwick | 224/183 |
| 3,638,893 | 2/1972 | Wendland | 248/312 |
| 3,938,769 | 2/1976 | Wetherbee | 248/312 |
| 4,278,225 | 7/1981 | Phelps | 248/311.13 |
| 4,915,337 | 4/1990 | Iwasaki | 248/311.2 |
| 4,949,889 | 8/1990 | Carson | 224/270 |
| 4,951,910 | 8/1990 | March | 248/311.2 |
| 4,957,253 | 9/1990 | Roy et al. | 248/104 |
| 4,993,611 | 2/1991 | Longo | 224/148 |
| 5,062,603 | 11/1991 | Spina | 224/270 |
| 5,114,061 | 5/1992 | Brady | 224/252 |
| 5,135,189 | 8/1992 | Ghazizadeh | 248/104 |
| 5,192,041 | 3/1993 | Bryant | 248/104 |
| 5,232,137 | 8/1993 | Devine | 224/252 |
| 5,249,770 | 10/1993 | Louthan | 248/230.8 |
| 5,302,302 | 4/1994 | Shelley et al. | 224/148 |
| 5,325,991 | 7/1994 | Williams | 220/739 |
| 5,456,432 | 10/1995 | Ennis et al. | 248/102 |
| 5,489,075 | 2/1996 | Ible | 248/104 |
| 5,609,283 | 3/1997 | Harrison, Jr. | 224/678 |
| 5,613,657 | 3/1997 | Olaiz | 248/102 |
| 5,743,620 | 4/1998 | Rojas et al. | 362/101 |
| 5,887,830 | 3/1999 | Liang | 248/316.7 |

*Primary Examiner*—Derek J. Berger
*Assistant Examiner*—Michael Nornberg
*Attorney, Agent, or Firm*—J. E. McTaggart

[57] ABSTRACT

A bottle holder, for personal transportation of a flexible plastic beverage bottle, has a horizontal upper portion, an inclined intermediate portion and a vertical lower portion that can be molded in one piece from plastic. The intermediate and upper portions are configured with an oval slot that is dimensioned, at its first end located in the intermediate holder portion, to accept the neck of a bottle which is then slid into place into a smaller-sized support area at the second slot end located in the horizontal upper holder portion, where the bottle becomes supported by the neck ring resting on the support area of the holder. The lower portion of the holder is configured in an inverted U-shape with two parallel arms having parallel horizontal gripping ribs on the interfacing surfaces of the arms, for clipping the holder onto a user's belt, or other object. A Velcro type strap, passing through a pair of slots in flanges at opposite edges of one of the arms, encircles the bottle and secures it to the holder to prevent unwanted movement of the bottle.

3 Claims, 7 Drawing Sheets

WATER AND SODA BOTTLE HOLDER

FIELD OF THE INVENTION

The present invention relates to the general field of article carriers/supports and more particularly it relates to a device for supporting a plastic bottle of liquid beverage such as water or soda, on a user's person, for purposes of activities such as biking or hiking.

BACKGROUND OF THE INVENTION

Bottle holders have been known and used in the past, e.g for holding nursing bottles for babies. Known bottle holders have been complex in construction, typically made from metal, inconveniently large in size, heavy in weight and/or unable to accommodate a variety of different sized bottles.

DISCUSSION OF RELATED KNOWN ART

U.S. Pat. No. 5,135,189 to Ghazizadeh uses a flexible arm member that is heavy in weight and complex in structure.

U.S. Pat. No. 4,957,253 to Roy et al. discloses a bottle holder that is clamped to a fixed object and is not advised to be worn by a human.

OBJECTS OF THE INVENTION

It is a principal object of the invention to provide a bottle holder for personal conveyance of a liquid beverage for activity purposes that is compact, light, simple in construction and that takes up a minimal amount of space.

It is a further object that the bottle holder should have no sharp or hard components that can harm a person wearing it during activities.

It is still a further object that the bottle holder should 35 be able to hold conventional plastic bottles of different size, shape and length, and prevent the bottle from falling down or swinging around.

SUMMARY OF THE INVENTION

The abovementioned objects have been accomplished by the present invention of a light, compact one-piece molded plastic liquid beverage bottle holder that accommodates different sizes, shapes and lengths of bottles. A large oval slot accepts the cap end of a water bottle in a midportion of the holder and allows the neck of the bottle to be slid in to a support area in the upper portion. The lower portion of the holder is configured as a clip with two arms to grip on to a user's belt or other supporting object, and is fitted with a Velcro-fastening bottle-securing strap that can be easily secured around the trunk of the bottle to prevent excessive swinging or other unwanted movement of the bottle.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
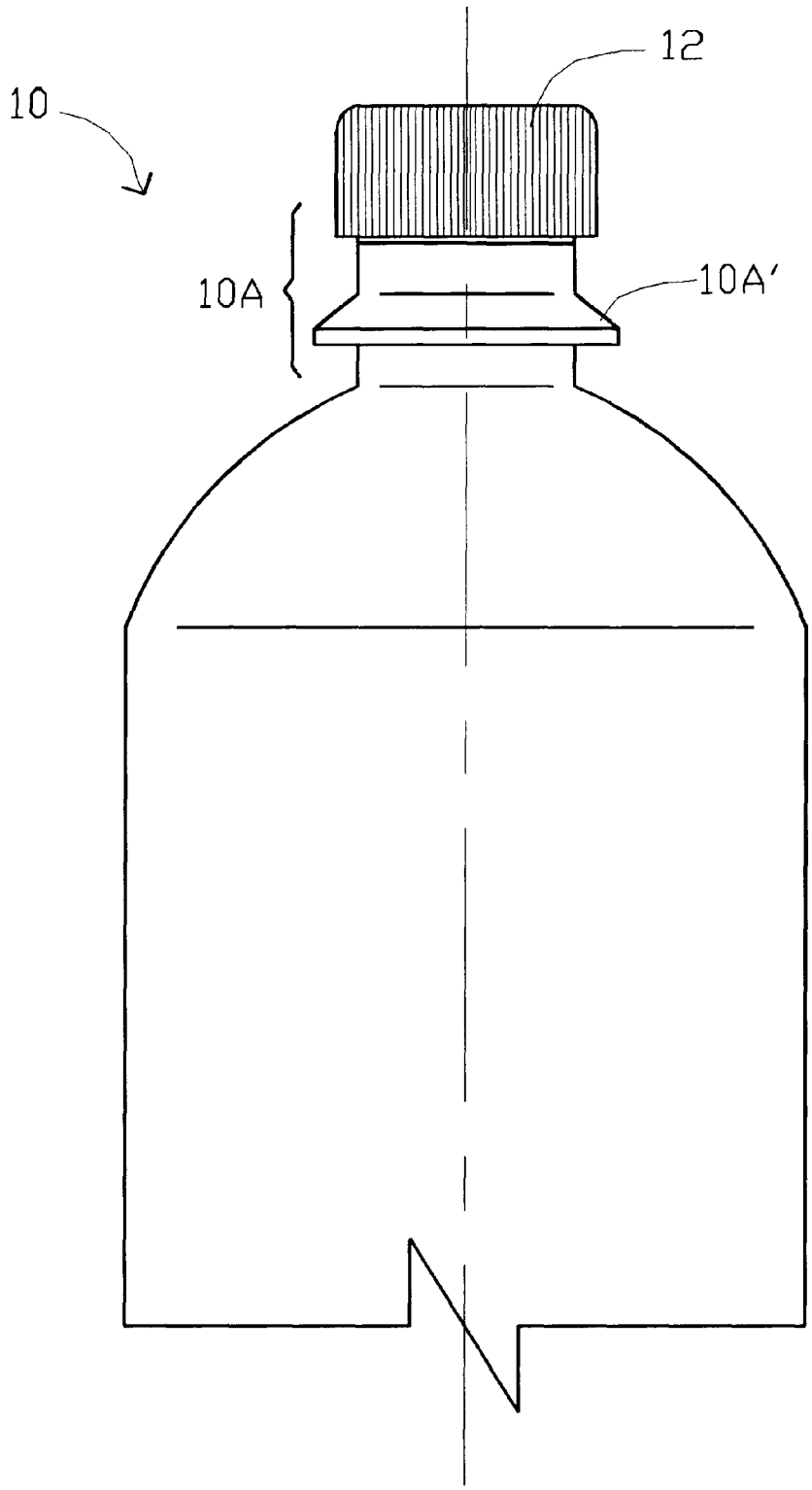
FIG. 1 is a side view of an upper portion of a bottle to be supported by the bottle holder of the present invention.

FIG. 1 is a side view of an upper portion of a plastic bottle 10 of a well-known conventional type that has become widely utilized for holding water or other liquid beverages: the present invention of a bottle holder is addressed to novel structure for holding such a bottle on a person, particularly for the convenience of a person engaging in physical activity such as biking or hiking.

Bottle 10 is typically molded from flexible clear plastic, and such bottles are widely available in a range of sizes ranging typically from about 1.4 inches to over 9 inches in length, and from about 2 inches to 3.25 inches in diameter.

The neck 10A is typically molded with threads in the upper portion for attachment of the removable cap 12, and is configured with an extending annular ring 10A' in the lower portion. For the various sized bottles, typically the diameter of the neck 10A ranges from 1.02 inches to 1.06 inches and the diameter of ring 10A' ranges from 1.22 to 1.29 inches: thus bottles of various sizes can be supported by a suitably-sized support structure, e.g. 1.15 inches across, that will engage the underside of ring 10A'.

Figure 2:
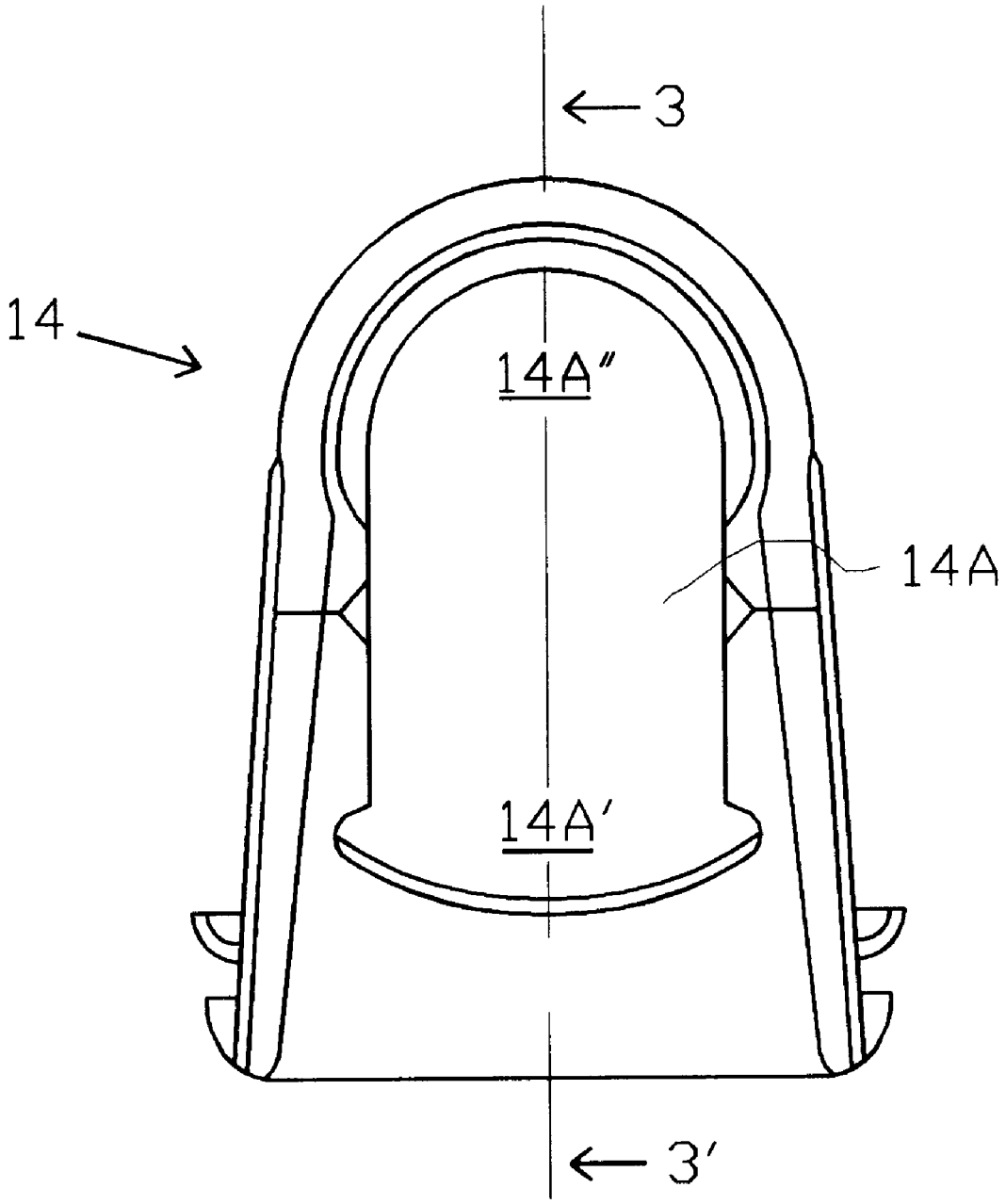
FIG. 2 is a top view of a bottle holder of the present invention for supporting a bottle such as that shown in FIG. 1.

FIG. 2 is a top view of a bottle holder 14 of the present invention, for supporting a bottle such as bottle 10 of FIG. 1 via the underside of ring 10A'. Holder 14 is configured with a large, generally oval-shaped slot 14A having a semi-circular supporting area 14A" at the top, as shown, extending downwardly with substantially parallel edges to an enlarged circular entry area 14A', which is made large enough to accept entry of the bottle cap (12, FIG. 1). The parallel edge area of slot 14A and the semi-circular shape of supporting area 14A" are dimensioned such as to closely clear the bottle neck and allow it to move upwardly from the entry area 14A' to the supporting area 14A" where the bottle is supported by the holder 14 engaging the underside of the neck ring.

Figure 3:
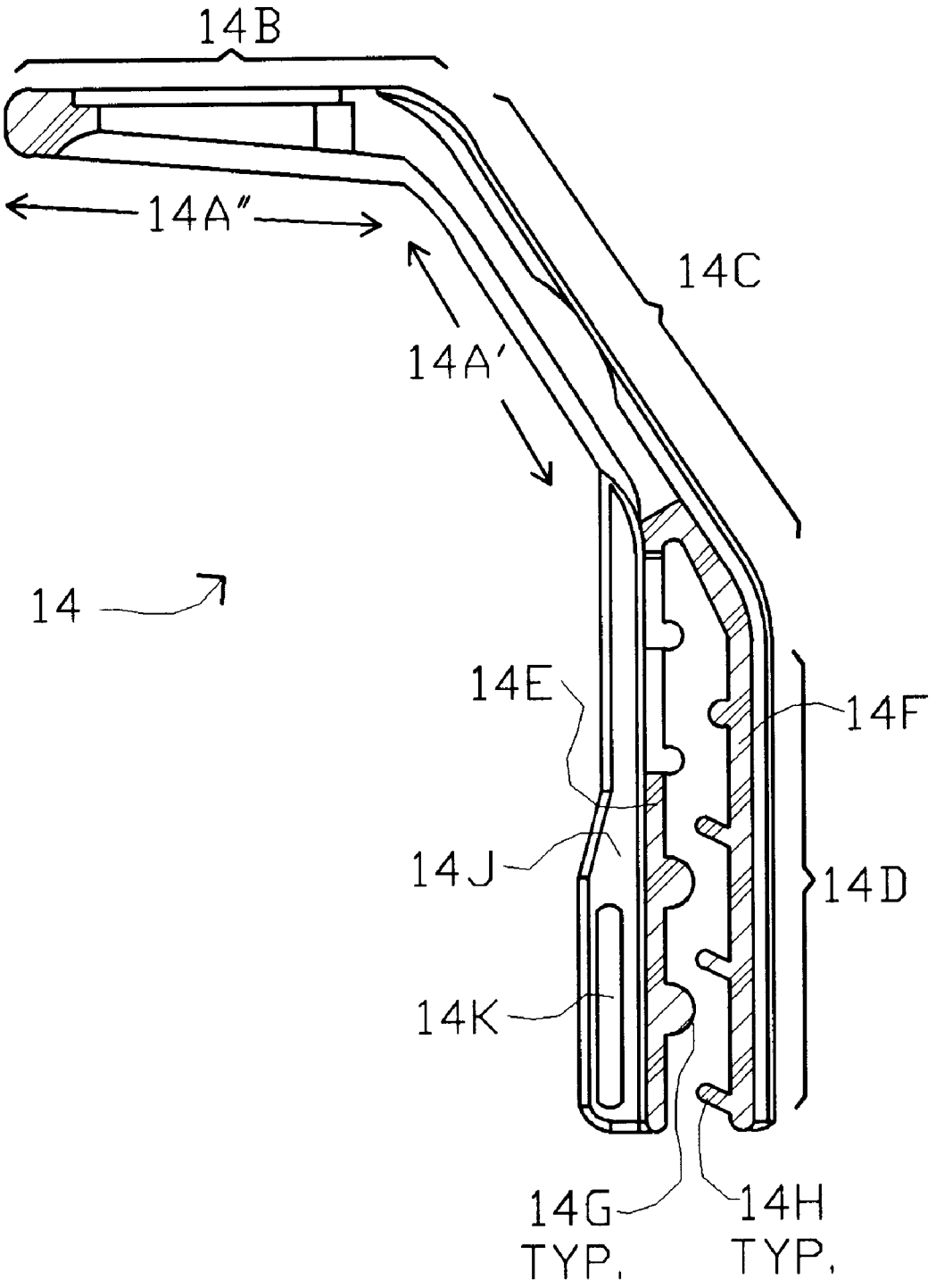
FIG. 3 is a cross-sectional side view of the bottle holder taken through A—A' of FIG. 2.

FIG. 3 is a cross-sectional side view of the bottle holder 14 taken through axis 3—3' of FIG. 2, showing the supporting area 14A" of slot 14A in a horizontal upper portion 14B of holder 14 that defines a bottle-support shoulder, and the enlarged lower entry area 14A' of slot 14A configured in the sloping intermediate portion 14C of holder 14.

The vertical lower portion 14D is formed in an inverted U-shape to form a belt hook having parallel arms 14E and 14F with interfacing walls each configured with a set of horizontal gripping ribs 14G and 14H, provided to ensure secure attachment on a user's belt or other supporting surface.

Figure 4:
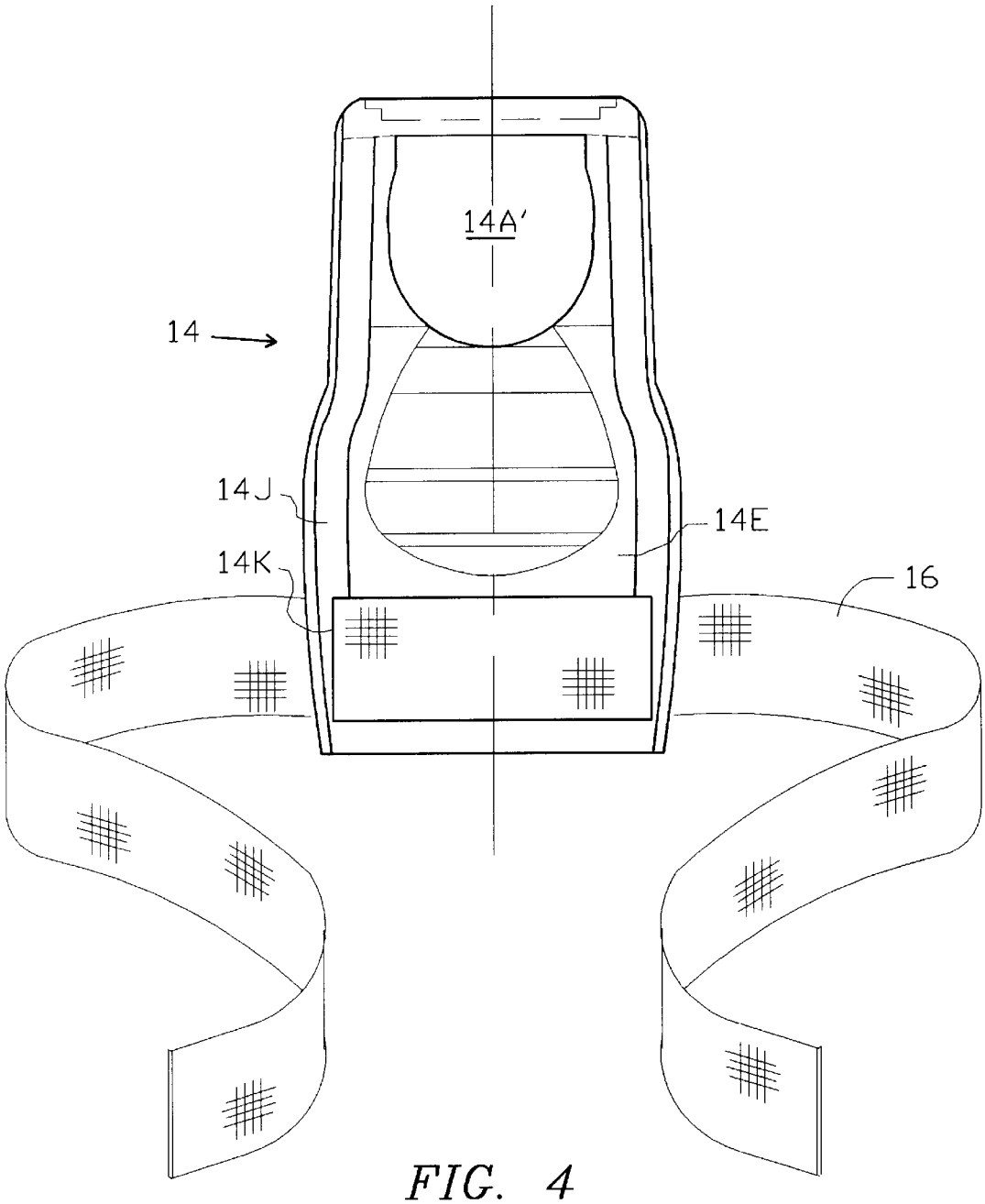
FIG. 4 is an elevational front view of the bottle holder of FIGS. 2 and 3, shown fitted with a holding strap.

A flange 14J is formed on each side of arm 14E (only one side appears in this view): flanges 14J are each configured with a vertically-elongated slot 14K for retaining a bottle-holding strap (not shown in this view, see FIG. 4).

Figure 3A:
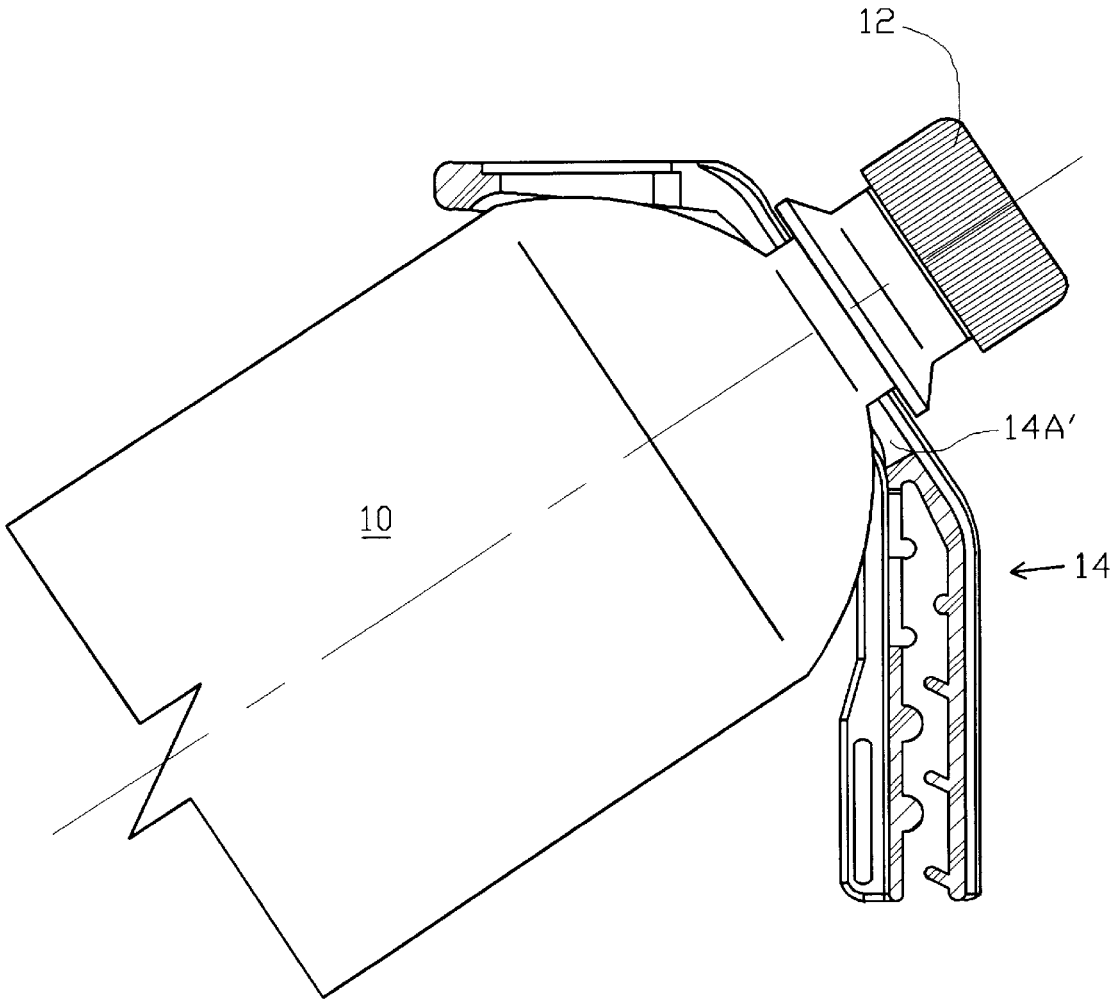
FIGS. 3A and 3B replicate FIG. 3, showing entry and support positions of a bottle.
Figure 3B:
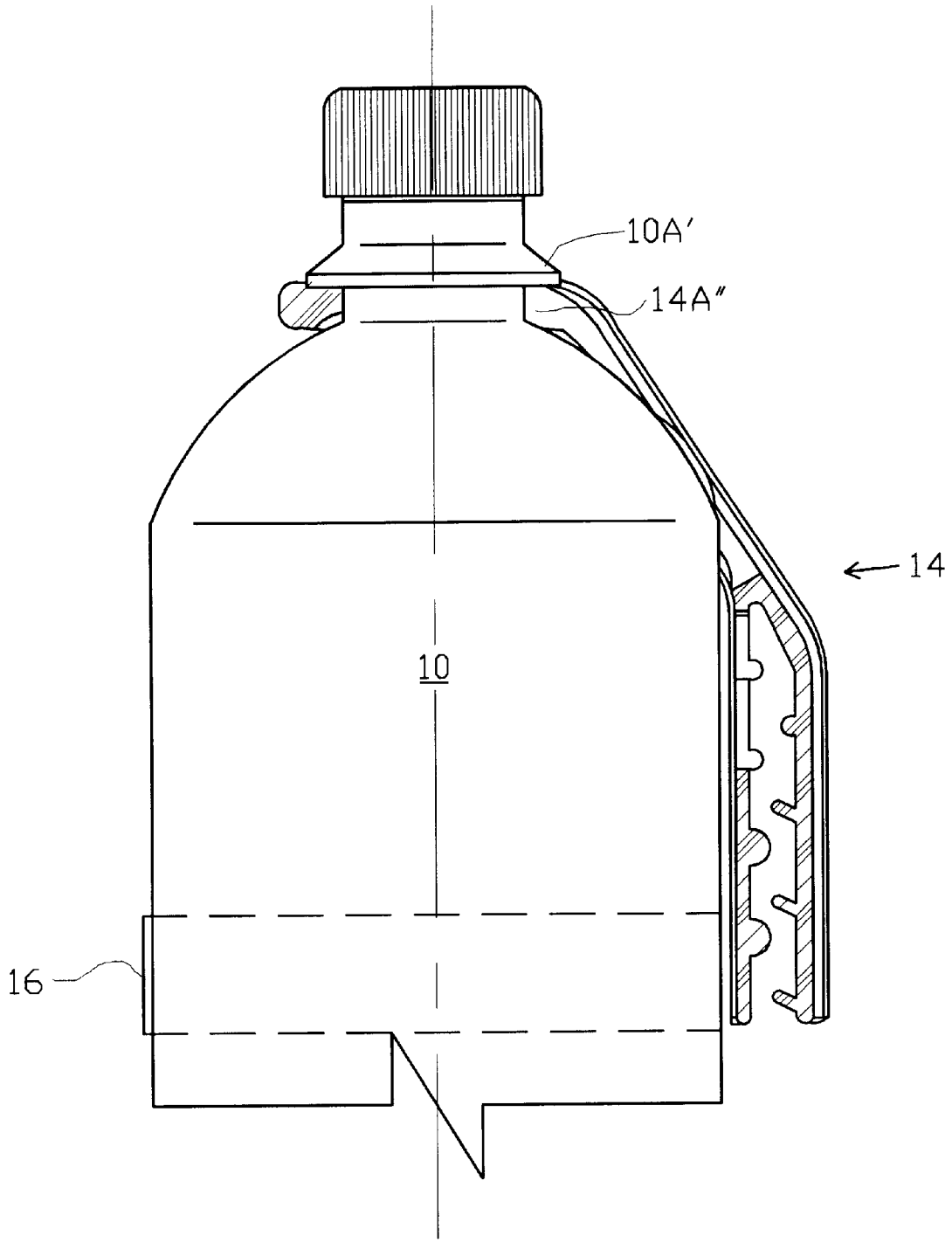

FIG. 3A replicates FIG. 3, showing the outline of a bottle positioned in the initial stage of attachment to holder 14, cap 12 having been inserted through the enlarged entry area 14A'. The parallel edge area of slot 14A and the semi-circular shape of upper support area 14A' (refer to FIG. 2) are dimensioned such as to closely clear the bottle neck and allow it to move upwardly from the entry position shown to its final position in the support area 14A" as shown in FIG. 3B, where bottle 10 becomes supported by the neck ring

10A' and secured in place with a strap 16, indicated by the dashed outline (see FIG. 4).

FIG. 4 is an elevational front view of the bottle holder 14 shown fitted with a holding strap 16 passing through openings 14K in flanges 14J of arm 14E, for securing the main body of the 3C bottle against unwanted movement. Securing strap 16 is made of Velcro type fastening material with hooks and loops on opposite sides. With strap 16 made 8½ inches long, holder 14 can accommodate a variety of bottles ranging in diameter from about 2 inches to 3¼ inches. Leg 14J is configured with an opening as shown that reveals arm 14F in this view, and serves to provide extra clearance to facilitate bottle entry.

Figure 5:
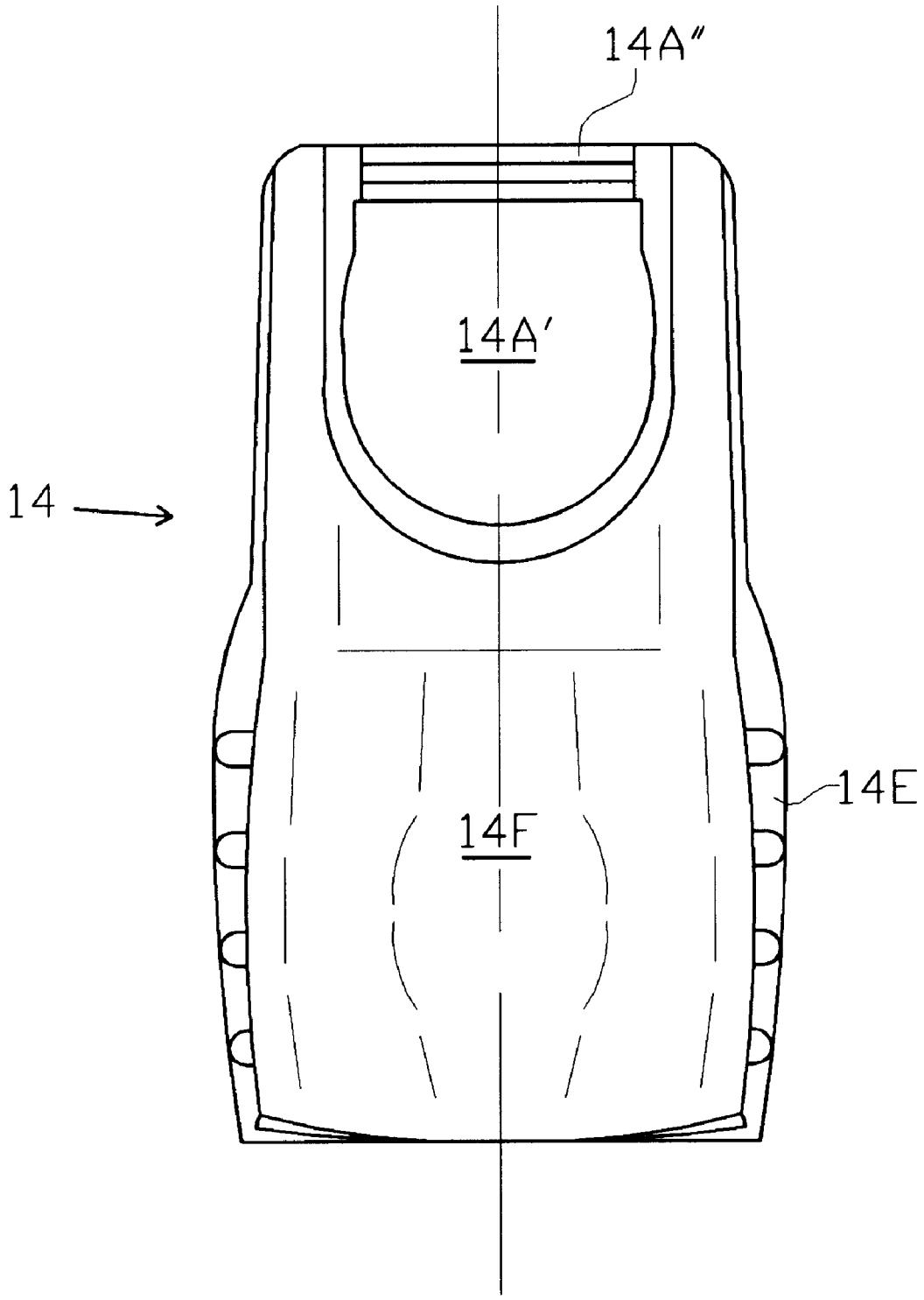
FIG. 5 is an elevational rear view of the bottle holder of FIG. 4, minus the strap.

FIG. 5 is an elevational rear view of the bottle holder 14, with the holding strap removed, showing arm 14F at the rear, a small portion of arm 14E extending beyond arm 14F, and showing entry area 14A' and the front wall of holding area 14A".

The particular shape of bottle holder 14 disclosed and described above represents an illustrative embodiment; the principles of the invention could be practiced by those of skill using equivalent alternative shapes for holder 14, and alternatively it could be made from metal.

Ribs 14G and 14H (FIG. 3) may be made semicircular in cross section as shown; alternatively some or all of the ribs may be made in an alternative shape such as a triangular or U-shaped.

Strap 16 could be of alternative material such as plastic and instead of Velcro, and could be fitted with alternative fasteners of known art.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

I claim:

1. A bottle holder comprising:

an integral, one-piece support body having a longitudinal and a transverse axis, said support body having an upper portion substantially perpendicular to a lower portion and having an intermediate portion obtusely connected to each of the upper and lower portions, wherein said support body is configured for supporting a cylindrical bottle having a neck and a trunk;

the upper and intermediate portions of said support body having an elongate oval slot for permitting the insertion of the neck of the bottle; the oval slot having a first end forming an insertion area located on the intermediate portion of said support body and the oval slot having a second end forming a supporting area located on the upper portion of said support body, the supporting area having a smaller width than the insertion area, whereby the neck may be inserted through the insertion area and slid into the supporting area thereby restricting the neck from sliding out of the slot's second end;

the lower portion of said support body having a U-shaped clip for attachment to a support surface, the U-shaped clip having a first arm parallel to a second arm;

the first arm and the second arm each having opposed surfaces which face each other, wherein at least one of the opposed surfaces is configured with gripping means for enhancing the attachment to the support surface;

the lower portion of said support body having two elongate lateral apertures in which a strap is inserted for encircling and securing the trunk of the cylindrical bottle; and the strap having a hook and loop fastening means for removably securing the cylindrical bottle to the lower portion of said support body.

2. The bottle holder as defined in claim 1 wherein the gripping means comprises a plurality of ribs which are substantially parallel to the transverse axis.

3. The bottle holder as defined in claim 2 wherein at least a majority of said ribs are made to be substantially semi-cylindrical in shape.

* * * * *